US005342534A

United States Patent [19]

Skrobala et al.

[11] Patent Number: 5,342,534

[45] Date of Patent: Aug. 30, 1994

[54] HARD SURFACE CLEANER

[75] Inventors: Catherine J. Skrobala, Elmwood Park; Keith J. Edgett, Ridgewood, both of N.J.; Paul A. Siracusa, Middletown, N.Y.

[73] Assignee: Eastman Kodak Company, Rochester, N.Y.

[21] Appl. No.: 999,022

[22] Filed: Dec. 31, 1992

[51] Int. Cl.[5] ..... C11D 1/66; C11D 3/48

[52] U.S. Cl. ..... 252/91; 252/174.17; 252/DIG. 10; 428/288

[58] Field of Search ..... 428/288; 252/174.17, 252/DIG. 10, 91

[56] References Cited

U.S. PATENT DOCUMENTS

| | | | |
|---|---|---|---|
| 3,928,249 | 12/1975 | Nunziata et al. | 252/526 |
| 3,950,276 | 4/1976 | Grand | 252/536 |
| 3,954,679 | 5/1976 | Wixon | 252/555 |
| 4,409,116 | 10/1983 | Lodico | 252/91 |
| 4,448,704 | 5/1984 | Barby et al. | 252/91 |
| 4,627,931 | 12/1986 | Malik | 252/153 |
| 4,666,621 | 5/1987 | Clark et al. | 252/91 |
| 4,673,523 | 6/1987 | Smith et al. | 252/91 |
| 4,753,844 | 6/1988 | Jones et al. | 428/288 |
| 4,784,786 | 11/1988 | Smith et al. | 252/91 |
| 4,822,511 | 4/1989 | Law | 252/106 |
| 4,946,617 | 8/1980 | Sheridan et al. | 252/91 |
| 5,028,620 | 7/1991 | Hsu | 514/372 |
| 5,035,838 | 7/1991 | Merrill et al. | 252/545 |
| 5,118,439 | 6/1992 | Urfer et al. | 252/174.17 |

*Primary Examiner*—Paul Lieberman
*Assistant Examiner*—Michael P. Tierney
*Attorney, Agent, or Firm*—J. Jeffrey Hawley

[57] ABSTRACT

A novel pre-moistened wiping article has been discovered comprising a flexible substrate carrying a liquid composition comprising an aqueous solution of: (1) from about 5 to about 15 weight % of a monohydric aliphatic alcohol having from 1 to about 6 carbon atoms; (b) from about 0.00015 to about 0.0045 weight % of a water soluble preservative; (c) from about 0.01 to about 1 weight percent of alkyl polyglycoside, wherein said weight percentages represent active ingredient percentages based on the total weight of the liquid composition. The invention is a low alcohol content wiping article that leaves a cleaned hard surface substantially streak free.

5 Claims, No Drawings

HARD SURFACE CLEANER

FIELD OF INVENTION

This invention relates to a wiping article for use in cleaning hard surfaces.

BACKGROUND OF THE INVENTION

Various liquid compositions have been described that have been particularly designed for the cleaning of hard surfaces without streaking or spotting.

There have also been described various hard surface wiping articles comprising substrates having incorporated thereon or therein certain surface treating agents or cleansing agents. Such wiping articles, included among which are those specifically designed to give streak-free results, are provided in (a) dry form and intended for use in the dry state, (b) dry form and intended to be used in conjunction with moisture, or (c) wet-impregnated form intended for use without the need for providing additional moisture.

U.S. Pat. No. 4,666,621 (issued to Clark et al. in 1987) describes a pre-moistened hard surface wiping article. The formulation used to moisten the article described in U.S. Pat. No. 4,666,621 is useful because after the surface to be cleaned is wet with the wipe, the released liquid dries by itself to leave a substantially streak free shine.

Employing a high alcohol content in the formulation used to moisten the wiping articles (also referred to herein as "wipes") of type described in the prior art has been associated with contributing to many desirable characteristics, including favorable liquid distribution, leveling properties, and preservation. Adding other ingredients to compensate for the decreased alcohol content is restricted because the inclusion of other ingredients has been associated with leaving a "streak" effect on the hard surface once the liquid dries. As used herein, the "streak" effect is defined as the residue left on the cleaned hard surface once the liquid from the wiping article dries.

Recent environmental concerns about the quantity of volatile organic compounds, such as alcohols, in consumer products have prompted research into reducing volatile organic compounds in formulations used in consumer products. One problem encountered in reducing the amount of alcohol in pre-moistened wiping articles, however, is that many of the desirable characteristics typical of high alcohol formulations are foregone when the alcohol content is reduced. Discovering alternative formulations for a wiping article that substantially avoids the "streak" effect is highly desirable, especially in light of the recent governmental regulations concerning decreasing the amount of volatile organic compounds in consumer and industrial use products.

SUMMARY OF THE INVENTION

The problem described above is solved with the present invention that is directed toward a novel pre-moistened wiping article. More particularly, the invention comprises a pre-moistened wiping article comprising a flexible substrate carrying a liquid composition comprising an aqueous solution of:

(a) from about 5 to about 15 weight % of a monohydric aliphatic alcohol having from 1 to about 6 carbon atoms;

(b) from about 0.00015 to about 0.0045 weight % of a water soluble preservative;

(c) from about 0.01 to 1 weight % of an alkyl polyglycoside;

wherein said weight percentages represent active ingredient percentages based on the total weight of the liquid composition.

The invention exhibits a synergistic effect with the discovery of a liquid cleaning composition having a low alcohol content that may be successfully impregnated onto a flexible substrate and still achieve results similar to those shown by a wiping article having a higher alcohol liquid formulation.

DETAILED DESCRIPTION OF THE INVENTION

By lowering the alcohol content of the formulation and increasing the percentage of water, the flash point of the liquid used to wet the article is raised thus making the product safer to manufacture and store. Also, the lower level of alcohol improves consumer aspects of the product. For example, the article is more amenable to contact with human skin, in other words the consumers' hands, and the fragrance of the product is improved with the lower level of alcohol. Additionally, by reducing the level of alcohol in the formulation, the wipe releases less volatile organic compounds into the atmosphere. These advantages of the novel formulation and wipe have been accomplished without contributing to the "streak" effect typically associated with the cleaning of hard surfaces. Once the liquid of the novel formulation dries, the hard surface cleaned is left virtually streak free.

As used herein, the ingredients of the liquid composition are set forth as active ingredient weight percentages based on the total weight of the liquid composition employed in the wiping articles, unless otherwise stated.

The pre-moistened wiping articles of the invention are particularly useful for cleaning of soiled hard surfaces because after the cleaning there is low deposition of residuals. The wipes are especially useful for the cleaning of lightly soiled surfaces such as windows, mirrors, and countertops to a substantially shiny, substantially streak-free and substantially lint-free condition. Preferably, one step cleaning may be accomplished such that the soiled surface need only be wiped with the pre-moistened wipe and allowed to air dry.

According to the invention, the wiping article comprises a flexible substrate impregnated with the liquid composition. The composition of the flexible substrate is preferably of a design to avoid leaving residue on the hard surface. Substrates of this sort are known to those skilled in the art. Preferably the flexible substrate comprises a mechanically bonded nonwoven material having good wet strength comprising from about 30 to about 60 percent by weight of wood pulp fibers and from about 70 to about 40 percent by weight of synthetic fibers (with said weight percentages based on total weight of the nonwoven material). The nonwoven material may also have incorporated therein an acrylic polymer (preferably hydrophobic).

The wood pulp fibers and synthetic fibers employed in the nonwoven material of the substrate are preferably textile length. Synthetic fibers such as rayon, nylon, orlon and polyester, as well as blends thereof (most preferably polyester) may be employed. More preferably, the nonwoven material is comprised of from about 55 to about 60 percent by weight wood pulp and from about 45 to about 40 percent by weight synthetic fibers, based on the total weight of the nonwoven material.

The acrylic polymers that may be incorporated into the nonwoven material of the substrate are preferably copolymers of monomeric acrylic esters such as, for example, ethyl acrylate, butyl acrylate, and methyl methacrylate, optionally in combination with functional monomers, such as, for example, styrene. These polymers are well known and widely commercially available in the form of emulsions. Typically, when employed, the acrylic polymers are incorporated into the substrate as emulsions containing the acrylic polymer(s), emulsifier, and water, the solids content of which is comprised predominantly of the acrylic polymer. Suitable acrylic emulsion polymers are preparable by methods known to those skilled in the art and are commercially available, including EMULSION E-940 emulsion (a soft, anionic, self-cross linking acrylic emulsion having a solids content of 45%) and RHOPLEX TM TR-934 emulsion (having a solids content of 44.5%), both available from the Rohm and Haas Company. When employed, preferably, the amount of acrylic polymer incorporated (also referred to as the "solids add on") in the substrate is from about 0.2 to about 2 weight percent based on the weight of the nonwoven material.

The flexible substrate may be prepared by any number of methods, as known to those skilled in the art. More particularly, for example, the fibers of the nonwoven material may be prepared from well known dry-form or wet-lay processes. Mechanical bonding of the nonwoven material may be accomplished by standard techniques such as, for example, thermo-bonding and spunlaced bonding. One preferred method of preparing the fibers employs mechanical bonding accomplished by a spunlaced process in which a fibrous web is subjected to high-velocity water jets that entangle the fibers. The nonwoven material may then be subjected to conventional drying and wind-up operations, as known to those skilled in the art. The treatment of the nonwoven material with the acrylic polymer emulsion (if employed) may be accomplished using standard processes and equipment as known to those skilled in the art (as described, for example in U.S. Pat. No. 4,661,621).

The flexible substrate may be prepared in various shapes, although sheet form is particularly useful. Although many unit weights of the flexible substrate may be used, a particularly preferred unit weight of substrate is in the range from about 55 to about 105 g/m$^2$.

As with the substrate, the formulation of the liquid composition used to premoisten (or wet) the flexible substrate is also designed to avoid the streaking of the hard surface cleaned by the wipe. Preferably the aqueous liquid composition with which the flexible substrate is wetted has a surface tension of less than 40 dynes/cm.

According to the invention, for use in the liquid composition, suitable alcohols include monohydric aliphatic alcohols, preferably having from one to about six carbon atoms, such as, for example, methanol, ethanol, isopropanol, hexanol, and mixtures thereof, as available commercially. A particularly preferred alcohol is ethanol. Preferably, the amount of alcohol employed in the composition is from about 5 to about 15 weight percent, more preferably from 5 to 10 weight percent, and most preferably from 5.6 to 8 weight percent.

Also necessarily included in the liquid composition used to wet the flexible substrate is an alkyl polyglycoside. Suitable alkyl polyglycosides are known nonionic surfactants which are alkaline and electrolyte stable. Alkyl mono and polyglycosides are prepared generally by reacting a monosaccharide, or a compound hydrolyzable to a monosaccharide with an alcohol such as a fatty alcohol in an acid medium. Various glycoside and polyglycoside compounds including alkoxylated glycosides and processes for making them are disclosed in U.S. Pat. Nos. 2,974,134; 3,219,656; 3,598,865; 3,640,998; 3,707,535; 3,772,269; 3,839,318; 3,974,138; 4,223,129; and 4,528,106.

A preferred group of alkyl glycoside surfactants suitable for use in the practice of this invention may be represented by formula I below:

$$RO—(R^2O)_y—(G)_xZ_b \qquad \text{I}$$

wherein

R is a monovalent organic radical containing from about 6 to about 30 (preferably from about 8 to about 18) carbon atoms;

$R^2$ is a divalent hydrocarbon radical containing from about 2 to about 4 carbon atoms;

O is an oxygen atom;

y is a number which has an average value from about 0 to about 1 and is preferably 0;

G is a moiety derived from a reducing saccharide containing 5 or 6 carbon atoms; and x is a number having an average value from about 1 to 5 (preferably from 1.1 to 2);

Z is $O_2M^1$, $$\overset{O}{\overset{\|}{OC}}—R^3,$$

$O(CH_2)$, $CO_2M^1$, $OSO_3M^1$, or $O(CH_2)SO_3M^1$; $R^3$ is $(CH_2)CO_2M^1$ or $CH{=}CHCO_2M^1$; (with the proviso that Z can be $O_2M^1$ only if Z is in place of a primary hydroxyl group in which the primary hydroxyl-bearing carbon atom, $—CH_2OH$, is oxidized to form a $$\overset{O}{\overset{\|}{—C}}—OM^1$$

group);

b is a number of from 0 to 3x+1 preferably an average of from 0.5 to 2 per glycosal group;

p is 1 to 10, $M^1$ is H+ or an organic or inorganic cation, such as, for example, an alkali metal, ammonium, monoethanolamine, or calcium.

As defined in Formula I, R is generally the residue of a fatty alcohol having from about 8 to 30 and preferably 8 to 18 carbon atoms. Particularly preferred alkylglycosides include, for example, APG TM 325 CS GLYCOSIDE (a 50% $C_9$-$C_{11}$ alkyl polyglycoside, also commonly referred to as D-glucopyranoside, available from Henkel Corporation, Ambler, Pa.) and GLUCOPON TM 625 CS (a 50% $C_{10}$-$C_{16}$ alkyl polyglycoside, also commonly referred to as a D-glucopyranoside, also available from Henkel Corporation).

Preferably, the alkyl polyglycoside is present in the liquid cleaning composition in an amount ranging from about 0.01 to about 1 weight percent (more preferably from 0.01 to 0.5 weight percent, and most preferably about 0.05 to 0.15 weight percent).

With regard to the preservative ingredient of the liquid composition, since a significant portion of the formulation comprises water, it is preferable that the preservative be water soluble. Further, it is preferred that the preservative is in a liquid form when added to the composition. Preferably, the preservative may be selected from glutaraldehyde, formaldehyde, 2-bromo-2-nitropropoane-1,3-diol sold by Inolex Chemicals under the tradename BRONOPOL TM, 5-chloro-2-methyl-4-isothiazolin-3-one, 2-methyl-4-isothiazoline-3-one, and mixtures thereof. More preferably employed is a combination 5-chloro-2-methyl-4-isothiazolin-3-one and 2-methyl-4-isothiazolin-3-one where the amount of either component may be present in the mixture anywhere from 0.001 to 99.99 weight percent, based on the total amount of the preservative. For reasons of availability, the most preferred preservative are those commercially available preservative comprising a mixture of 5-chloro-2-methyl-4-isothiazolin-3-one and 2-methyl-4-isothiazolin-3-one marketed under the tradename KATHON TM CG-ICP preservative by Rohm and Haas.

According to the invention, a small amount of the preservative is sufficient in preserving the wiping article. According to the invention, the preservative is employed in an amount to substantially avoid a streak effect. Preferably the preservative is employed in the liquid composition within the range of from about 0.00015 to about 0.0045 weight percent, more preferably from 0.0004 to 0.0015 weight percent, and most preferably from 0.0006 to 0.0009 weight percent, based on the total weight of the liquid composition.

Optionally, as long as the "streak" effect is substantially avoided, the liquid composition may contain one or more surfactant(s) selected from the group consisting of the following:

(a) polyethylene oxide condensates of alkyl phenols, having a straight or branched alkyl of from about 6 to about 12 carbon atoms, with ethylene oxide wherein the amount of ethylene oxide present is from about 3 to about 25 moles per mole of alkyl phenol;

(b) condensation products of aliphatic alcohols with ethylene oxide of the formula $R^*O(C_2H_4O)_nH$, wherein R* is straight or branched alkyl having from about 8 to about 22 carbon atoms and n is 3 to 40;

(c) polyoxyethylene polyoxypropylene block polymers; and (d) fluorinated surfactants such as, for example, anionic, nonionic, cationic and amphoteric fluorosurfactants marketed by E. I. Dupont de Nemours and Company under the trademark ZONYL TM, e.g. ZONYL TM FSK, an amphoteric fluorosurfactant, ZONYL TM FSN, a fluorosurfactant, ZONYL TM FSJ, an anionic fluorosurfactant and ZONYL TM FSC, a cationic fluorosurfactant.

More preferably, when an additional (optional) surfactant is employed in the liquid composition, that selected is a $C_{12}$-$C_{15}$ linear primary alcohol ethoxylate [more preferably, a $C_{12}$-$C_{15}$ linear primary ethoxylate having 7 moles EO (ethylene oxide) per mole of alcohol, as commercially available under the trademark NEODOL TM 25-7 supplied by Shell Chemical Company, Houston, Tex.].

When included, the preferred amount of the optional surfactant(s) employed in the liquid composition from 0.0001 to about 1 weight percent, more preferably from 0.0006 to about 0.03 weight percent, and most preferably from 0.003 to 0.012 weight percent.

The liquid cleaning composition may, if desired, include other additional ingredients in small amounts to provide additional benefits. Such optional ingredients are, for example, perfumes and fragrances and additional agents for improving soil removal and wetting and surface characteristics, as known to those skilled in the art. Optional agents which improve soil removal are, for example, glycol ethers such as the methyl and ethyl ethers of ethylene glycol, propylene glycol and dipropylene glycol. Such agents can be included up to about 2 percent by weight of the liquid composition. Optional agents for improving wetting characteristics that may be employed include, for example, low molecular weight glycols such as ethylene glycol and dipropylene glycol, which can be employed in amounts up to about 1 percent by weight of the liquid composition. Optional agents for improving surface characteristics are film forming agents such as the partially esterfied resins described in U.S. Pat. No. 4,447,704. Such agents can be employed in amounts up to about 1 percent by weight of the liquid composition.

The liquid composition is preferably an aqueous solution. The water employed in the liquid cleaning composition is preferably demineralized.

The wetting of the flexible substrate (referred to herein as the "loading") may be accomplished by suitable methods known to those skilled in the art. In order to provide for satisfactory streak-free cleaning of hard surfaces, the flexible substrate should not be overloaded with the liquid composition. Overloading will result in an excessive amount of the liquid composition remaining on the hard surface thus leading to streaking. Underloading, on the otherhand, should also be avoided because the wipe will not clean as much surface area as a properly loaded wipe.

Proper loading of the flexible substrate with the liquid cleaning composition of the invention may generally be accomplished by taking into account the percentage of pulp in the flexible substrate. For example, the amount of liquid employed preferably is within the range of about 330 to about 530 percent of the weight of the wood pulp fibers, more preferably from about 380 to about 480 percent and most preferably from about 410 to about 440 percent.

The pre-moistened wipes of the invention preferably are packaged in a manner which will maintain them in a moist condition. A variety of well known packaging methods are available. For example, the wipes may be individually packaged in moisture impervious envelopes or packaged in bulk form in cannisters provided with suitable dispensing openings. When packaged in bulk form, they may be provided as separate sheets, for example, in interleaved form, or in the form of interconnected sheets from which individual sheets may readily be separated. In the latter case, reference is made to U.S. Pat. No. 4,017,002.

Although the amount of preservative employed in the liquid composition of the wiping article is minimal, the formulation of the liquid composition unexpectedly exhibits good preservation activity. The wiping article is sufficiently preserved and is still effective as a cleaning substrate that leaves a cleaned hard surface virtually "streak" free.

The cleaning of soiled hard surface using the invention may be accomplished by many techniques, as known to those skilled in the art.

The invention is illustrated by the following nonlimiting examples.

EXAMPLE 1

Liquid compositions M-S were prepared according to the formulation shown in Table I, hereinafter, with numerical values representing ingredient weight percentages as commercially available, based on the total weight of the liquid composition. Active ingredient weight percentages are listed in the footnote section of the Tables.

TABLE I

| Composition | Liquid Compositions (Active Ingredient Amounts in Parenthesis) | | | | | | |
|---|---|---|---|---|---|---|---|
| | M | N | O | P | Q | R | S |
| water | 93.43 (93.43) | 93.43 (93.43) | 91.49 (91.49) | 91.50 (91.50) | 91.41 (91.41) | 91.31 (91.31) | 93.41 (93.41) |
| ethanol[1] | 6.30 (5.98) | 6.30 (5.98) | 8.42 (8.0) | 8.42 (8.0) | 8.42 (8.0) | 8.42 (8.0) | 6.32 (6.0) |
| GLUCOPON 625 CS[2] | 0.20 (0.1) | — | 0.02 (0.01) | — | — | — | — |
| APG 325 CS[3] | — | 0.20 (0.10) | — | 0.01 (0.005) | 0.10 (0.05) | 0.20 (0.10) | 0.20 (0.10) |
| Fragrance[4] | 0.02 (0.02) | 0.02 (0.02) | 0.02 (0.02) | 0.02 (0.02) | 0.02 (0.02) | 0.02 (0.02) | 0.02 (0.02) |
| KATHON CG/ICP II[5] | 0.05 (0.0008) | 0.05 (0.0008) | 0.05 (0.0008) | 0.05 (0.0008) | 0.05 (0.0008) | 0.05 (0.0008) | 0.05 (0.0008) |

Ethyl alcohol (95%); Supplier: Shell Chemical Co.
[2] $C_{10}$–$C_{16}$ alkylyl polyglycoside (50%); Supplier: Henkel Corporation, Ambler, Pa.
[3] $C_9$–$C_{11}$ alkyl polyglycoside (50%); Supplier: Henkel Corporation, Ambler, Pa.
[4] Fragrance L2151 from Shaw Mudge & Co. (100%), used exclusively as the fragrance throughout the examples.
[5] The active ingredient in the KATHON product is a combination of 5-chloro-2-methyl-4-isothiazolin-3-one (1–1.20 weight percent) and 2-methyl-4-isothizaolin-3-one (0.25–0.45 weight percent); magnesium chloride and nitrate (1.4–2.0 weight percent) cupric nitrate (0.15–0.17); and water (95.5–96.2); Supplier: Rohm & Haas.

The liquid compositions were used to wet flexible nonwoven substrates having dimensions of 10"×7½" were prepared using a modified SONTARA TM 8801. The SONTARA substrate was acquired from E. I. DuPont de Nemours & Co. Modifications to the SONTARA substrate were such that cationic dyes were not employed and wood pulp contained maximum tolerances of extractables, i.e. calcium salts, as described in more detail hereinafter. More particularly, the substrate was a spunlaced fabric sheet containing a blend of about 59% (±3%) wood pulp fibers dyed to a turquoise shade with a bleedfast dye and about 41% (±3%) polyester fibers (DuPont DACRON TM) and having a unit weight of approximately 62.7 g/m². This fabric was prepared by producing a polyester fiber backbone by a carded process and laminating thereto a sheet of wood pulp fibers by water-needling whereupon the polyester and woodpulp fibers were entangled. (The wood pulp fibers had a maximum level of calcium carbonate of 400 PPM; calcium maximum of 250 PPM; and sodium maximum of 250 PPM.) The fabric was treated with EMULSION TM E-940 so as to provide a solids add-on after oven curing of 0.85% by weight of the untreated substrate.

Wipes M-S were prepared by impregnating one sheet per liquid compositions M-S with 8 grams of liquid. A streak test for each wipe was performed by testing each wipe on a previously cleaned, streak free black glass panel. The surface of the panel was wiped once horizontally across the width of the panel with the same wipe and allowed to air dry. The panel was then visually evaluated for spotting and streaking. Numerical ratings were assigned to each formula based on the amount of streaking (residue) left on the panels after drying, with a scale of 1 to 10, with 1=no streaks observed and 10=severe streaks observed.

TABLE II

| Results of Streak Test | |
|---|---|
| Wipe | Streak Rating |
| M | 1 |
| N | 1 |
| O | 3–4 |
| P | 5 |
| Q | 2 |
| R | 1 |
| S | 1 |

EXAMPLE II

To demonstrate preservation effectiveness, liquid compositions M and N were tested for microbiological preservation (as well as a CONTROL composition containing no preservative (i.e. no KATHON was employed). The test organisms were *Aspergillus niger* ATCC #6275 and *Eupenicillium levirum* ATCC #10464. The liquid compositions were inoculated with the organisms with 1.0 ml of the $1\times10^6$ spores/ml mixed mold suspension of organisms. After the liquid compositions were inoculated, the test samples were stored at room temperature. Monitoring of the samples was done visually.

The overall results of the microbiological test showed that all test organisms disappeared from the samples of compositions M and N. The CONTROL samples (containing no KATHON preservative) exhibited heavy growth of each of the test organisms throughout the test period.

Comparative Example I

The comparative liquid compositions shown in Tables III and IV below demonstrate that the unexpected synergistic effect of "no streaking" is present only with the inventive liquid compositions. Although similar type of compounds were employed in preparing the comparative compositions, only when the inventive liquid composition was used did a minimized streak effect result. Wipes prepared with the same substrate as those in Example 1 were loaded with the liquid compositions designated COMPOSITIONS 1–6. Each were tested for streaking, as described in Example I. Results appear in Table V.

TABLE III

| COMPOSITION | Liquid Compositions Comparisons (Active Ingredient Amounts in Parenthesis) 1 | 2 | 3 | 4 | 5 | 6 |
|---|---|---|---|---|---|---|
| water | 93.58 (93.58) | 93.63 (93.63) | 93.63 (93.63) | 93.63 (93.63) | 93.63 (93.63) | 93.63 (93.63) |
| ethanol[1] | 6.32 (6.00) | 6.32 (6.00) | 6.32 (6.00) | 6.32 (6.00) | 6.32 (6.00) | 6.32 (6.00) |
| ALCODET TM HSC-1000[2] | 0.10 (0.98) | 0.05 (0.49) | — | — | — | — |
| AEROSOL TM OT-75[3] | — | — | — | 0.05 (0.04) | — | — |
| SILWET TM L 7604[4] | — | — | — | — | 0.05 (0.05) | — |
| SILWET TM L 7602[5] | — | — | — | — | — | 0.05 (0.05) |
| NEODOL TM 25-3A[6] | — | — | 0.05 (0.03) | — | — | — |

[1] Ethyl alcohol (95%); Supplier: Shell Chemical Co.
[2] Dodecylthioethoxylate (98%) from Supplier: Rhone-Poulenc
[3] Dioctyl sodium sulfosuccinate (75% solution in water and alcohol); Supplier: American Cyanamid Co.
[4] Silicone glycol copolymer (100%); Supplier: Union Carbide Corp.
[5] Silicone glycol copolymer (100%); Supplier: Union Carbide Corp.
[6] Ethoxylated alcohol, ammonium salt (58%); Supplier: Shell Chemical Co.

TABLE IV

| Wipe | Results of Streak Test (Comparisons) Streak Rating |
|---|---|
| 1 | 6 |
| 2 | 5 |
| 3 | 7.5 |
| 4 | 7 |
| 5 | 9 |
| 6 | 8 |

The invention has been described in detail with particular reference to preferred embodiments thereof, but it will be understood that variations and modifications can be effected within the spirit and scope of the invention. The teachings of all journal articles and patents cited herein are understood to be incorporated by reference in as much as they pertain to this invention.

What is claimed is:

1. A pre-moistened wiping article comprising a flexible substrate carrying a liquid composition consisting of an aqueous solution of:
   (a) from about 5 to about 15 weight % of a monohydric aliphatic alcohol having from 1 to about 6 carbon atoms;
   (b) from about 0.00015 to about 0.0045 weight % of a water soluble preservative selected from the group consisting of glutaraldehyde, formaldehyde, 2-bromo-2-nitopropane-1,3-diol, 5-chloro-2-methyl-4-isothiazolin-3-one, 2-methyl-4-isothiazoline-3-one, and mixtures thereof;
   (c) from about 0.01 to about 1 weight % of an alkyl polyglycoside,
   wherein said weight percentages represent active ingredient percentages based on the total weight of the liquid composition and the balance of said liquid composition is water.

2. A pre-moistened wiping article according to claim 1 wherein said alcohol is selected from the group consisting of methanol, ethanol, isopropanol, hexanol, and mixtures thereof and said alcohol is present in an amount ranging from 5 to 10 weight percent.

3. A pre-moistened wiping article according to claim 2 wherein said preservative is selected from the group consisting of 5-chloro-2-methyl-4-isothiazolin-3-one, 2-methyl-4-isothiazolin-3-one, or a mixture thereof and said alcohol is present in an amount ranging from 5.8 to 8 weight percent.

4. A pre-moistened wiping article according to claim 3 wherein said preservative is a mixture of 5-chloro-2-methyl-4-isothiazolin-3-one and 2-methyl-4-isothiazolin-3-one present in an amount ranging from 0.0006 to 0.0009 weight percent; said alcohol is ethanol; and said alkyl polyglycoside is a $C_9$ to $C_{11}$ alkyl polyglycoside present in an amount ranging from 0.05 to 0.15 weight percent.

5. A pre-moistened wiping article comprising a flexible substrate carrying a liquid composition consisting of an aqueous solution of:
   (a) from about 5 to about 15 weight % of a monohydric aliphatic alcohol having from 1 to about 6 carbon atoms;
   (b) from about 0.00015 to about 0.0045 weight % of a water soluble preservative selected from the group consisting of glutaraldehyde, formaldehyde, 2-bromo-2-nitopropane-1,3-diol, 5-chloro-2-methyl-4-isothiazolin-3-one, 2-methyl-4-isothiazoline-3-one, and mixtures thereof;
   (c) from about 0.01 to about 1 weight % of an alkyl polyglycoside,
   (d) about 0.02 weight percent of a fragrance;
   wherein said weight percentages represent active ingredient percentages based on the total weight of the liquid composition, and the balance of said liquid composition is water.

* * * * *